United States Patent [19]

Shaw et al.

[11] 3,985,264

[45] Oct. 12, 1976

[54] SECURITY SYSTEM FOR CONTROLLED DRUGS

[76] Inventors: Joseph Denman Shaw; Adele G. Shaw, both of 508 Church St., Brownsville, Pa. 15417

[22] Filed: Aug. 11, 1972

[21] Appl. No.: 279,976

[52] U.S. Cl. ..... 221/7; 198/348; 221/13; 221/79; 235/61.11 E; 235/61.12 R

[51] Int. Cl.[2] ..... B65B 57/20

[58] Field of Search ..... 221/2, 5, 7, 9, 13, 221/70, 76, 77, 78, 79; 226/33, 43; 198/38; 235/61.11 E, 61.12

[56] References Cited

UNITED STATES PATENTS

| | | | |
|---|---|---|---|
| 3,182,791 | 5/1965 | Jenner | 206/42 X |
| 3,383,011 | 5/1968 | Reed et al. | 221/2 |
| 3,621,992 | 11/1971 | Osborne et al. | 206/42 X |
| 3,667,588 | 6/1972 | Traube | 198/38 |
| 3,680,967 | 8/1972 | Engelhardt | 235/61.11 E K |

*Primary Examiner*—Robert B. Reeves
*Assistant Examiner*—Francis J. Bartuska
*Attorney, Agent, or Firm*—Walter S. Murray

[57] ABSTRACT

An automatic system adapted to store, select for dispensation and count dispensed articles such as controlled drugs especially useful for the storage, dispensing and keeping of accurate, tamper proof records of controlled drugs in hospitals.

A novel programmed strip for the system is also disclosed.

11 Claims, 12 Drawing Figures

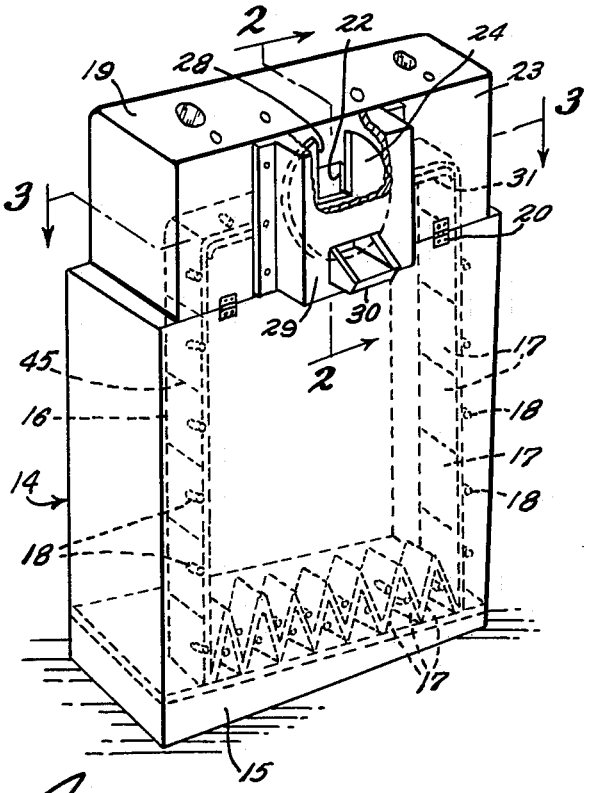
Fig. 1
Fig. 2
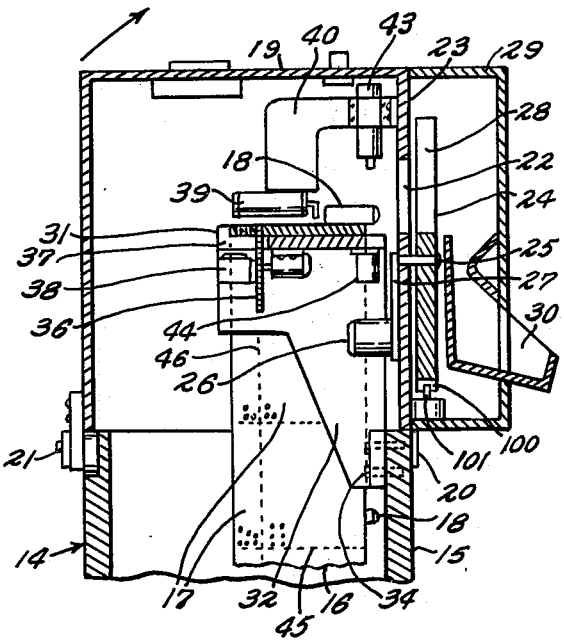
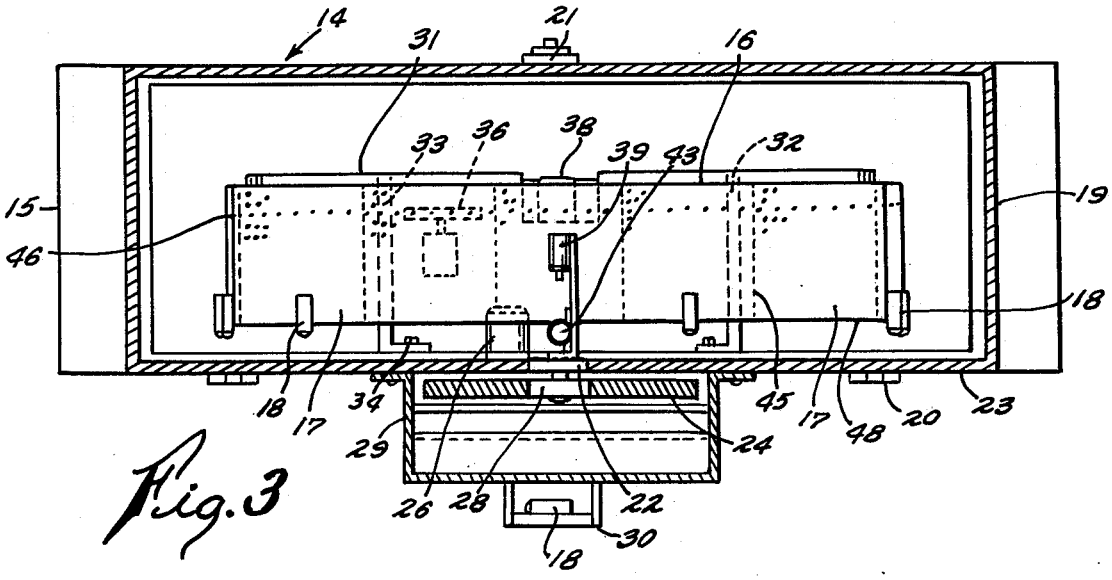
Fig. 3

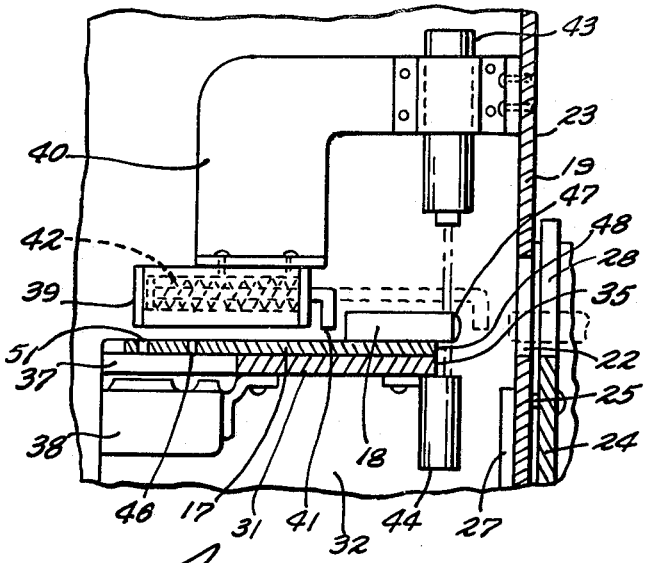
Fig.4
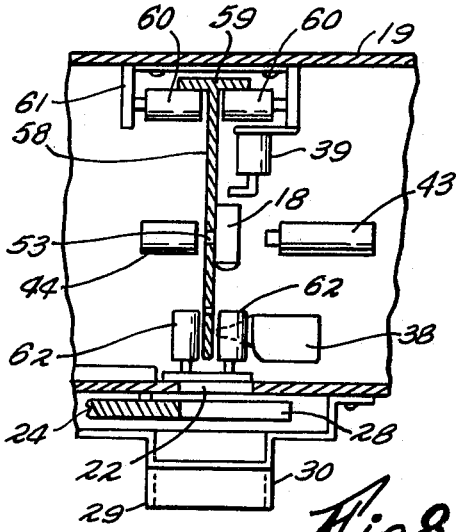
Fig.8
Fig.9
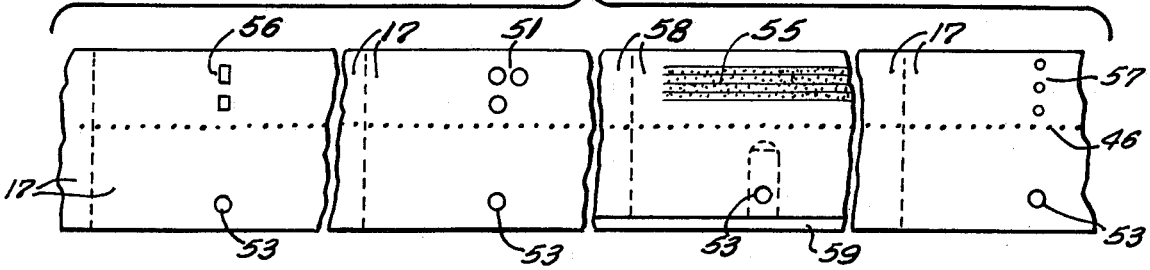
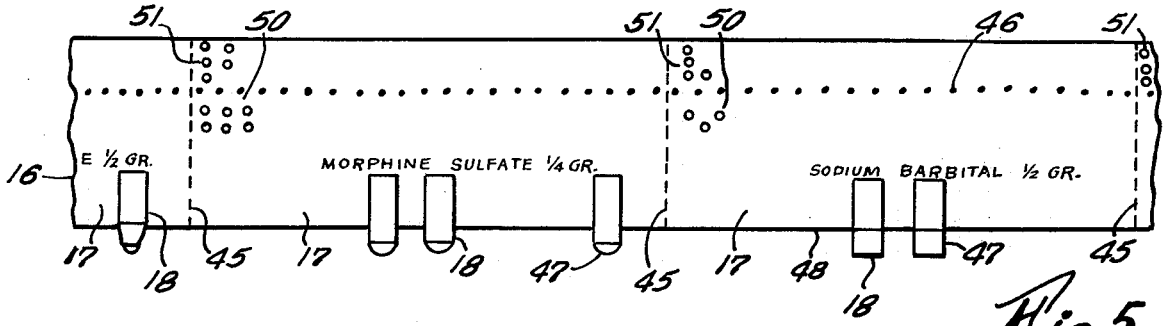
Fig.5
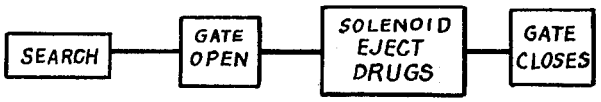
Fig.10
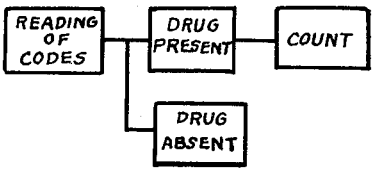
Fig.11

SECURITY SYSTEM FOR CONTROLLED DRUGS

This invention relates to a security system for the storage, selected dispensation and counting of dispensed articles and more particularly to means for storing, selecting for dispensation, automatic recording and counting the dispensation of controlled drugs, such as narcotics, amphetamines, barbituates, tranquilizers, or the like.

The storage, dispensing and keeping of accurate records of controlled drugs is a time consuming task for hospital personnel and not without human errors or the likelihood that records or drugs could be tampered with. Some of these problems are obviated by the system of this invention while other drawbacks have been substantially simplified.

An object of the invention is the provision of a novel coded card form which cooperates with a combination of conventional devices to secure a reliable and tamperproof system for the handling of controlled drugs and other like articles.

Another object of the invention is to provide a simplified system for dispensing and counting controlled drugs.

These and other objects of the invention will be apparent from the following specification taken in conjunction with the accompanying drawings, wherein like reference numerals indicate similar parts throughout the several views. In the drawings FIG. 1 is a perspective view of the drug storage, dispensing and counting apparatus for carrying out the system of the present invention, a casing being broken away and shown in section.

FIG. 2 is an enlarged section taken on line 2—2 of FIG. 1 depicting the drug dispensing station for the apparatus.

FIG. 3 is an enlarged section taken on line 3—3 of FIG. 1.

FIG. 4 is an enlarged, fragmental section like FIG. 2 showing details of the apparatus, parts being broken away.

FIG. 5 is a fragmental, plan view of our coded cards with machine readable language made up in strip form for use with the apparatus shown in FIGS. 1–4 of the drawings.

FIG. 8 is a sectional view like FIG. 4 showing a further modified form of our invention.

FIG. 9 is a fragmental plan view of various forms of coded cards with machine readable language that may be utilized with our invention.

FIG. 10 is a flow chart representing the drug dispensing steps of our invention.

FIG. 11 is a flow chart showing the drug counting steps of our invention.

Figure 6:
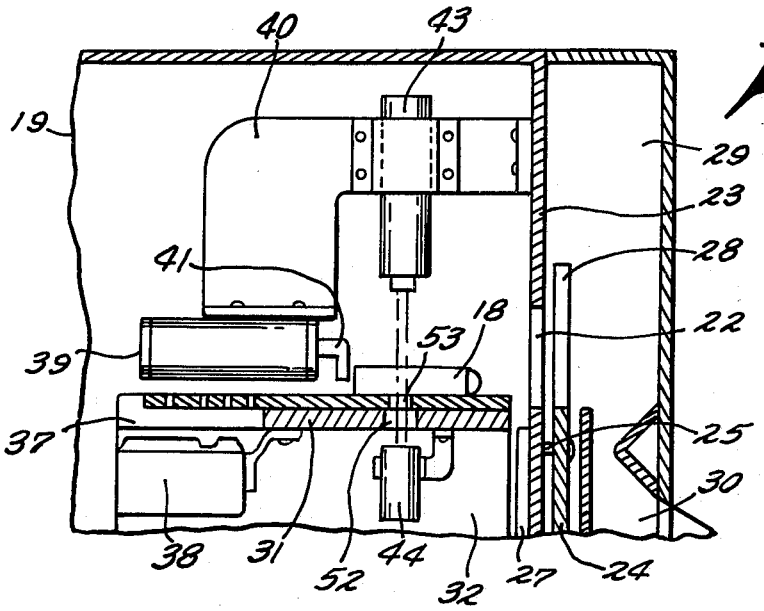
FIG. 6 is a sectional view like FIG. 4 depicting a modified form of our invention.

With particular reference to FIGS. 1–5 of the drawings there is shown a cabinet 14 having a base 15 that houses a strip 16 of hinge connected coded cards 17 with machine readable language, preferrably in the form of an endless belt, although a straight strip could be advantageously used. The card strip 16 carries a longitudinally spaced apart series of dispensable articles 18 and may be furnished in a folded, zig-zag from for convenience in storage and handling, as is illustrated by the dotted lines in FIG. 1 of the drawings. The cabinet has a top 19 hinged at 20 to the front upper edge portion of the base 15 and maintained in closed tamperproof condition by a key operated lock 21 mounted between the adjacent edges of the base and top at the back of the cabinet.

An article exit opening 22 is formed through the central portion of a front wall 23 of the cabinet top 19, said opening being made tamper proof by a spring closed gate that takes the form of a guard wheel 24 rotatably mounted in front of the exit opening 22 on a drive shaft 25 extending through the front wall and periodically driven against the bias of the spring into dispensing position by an electric motor 26 positioned on the inside of the front wall and operatively connected to the shaft through reduction gearing (not shown) in a housing 27 (FIG. 2). The guard wheel has a radial slot 28 formed therein which is periodically registered with the article exit opening 22 to allow dispensation of a selected article 18 therethrough. A casing 29 projects from the front of the cabinet to enclose the guard wheel 24, a zig-zag chute and hopper arrangement 30 being formed in the casing to deliver and hold an article in dispensed position.

A camming notch 100 is formed in the periphery of the guard wheel 24 to cooperate with a microswitch operated plunger 101 which positively positions the slot 28 in registry with the exit opening 22 when the system is programmed for the dispensation of a selected article.

A horizontal strip guide platform 31 is located within the cabinet top 19 and is mounted on a pair of laterally spaced brackets 32 and 33 each having their lower ends bolted to the cabinet base at 34. The upper face of the guide platform 31 is disposed on a level with the article exit opening 22, the front edge 35 of the platform being spaced away from the interior face of the front wall 23 of the cabinet top 19. An intermittently clutched motor driven strip feed wheel 36 is mounted beneath the rear portion of the guide platform 31, said central rear portion of the platform being also notched out to provide an opening 37 for a code reader head 38 located beneath the opening and mounted to the underside of the guide platform.

An article dispensing station is located behind the exit opening 22 and includes an ejector means which takes the form of a solenoid 39 mounted above the strip guide platform 31 on a bracket 40 secured to the inside of the front wall 23 of the cabinet top. As best shown in FIG. 4 of the drawings the solenoid has a plunger 41 disposed in alignment with the exit opening 22 and biased to retracted position by a spring 42. When actuated the solenoid functions to detach a selected article 18 from the strip 16 and push it out through the exit opening 22, the registered slot 28 in the gate wheel 24 and into the hopper 30 for dispensation.

An article detection means comprises an energy source 43 fixed on the bracket 40 and adapted to provide a source of energy directed at right angles to the movement of the strip 16 on the platform 31 and in the path of movement of articles on said strip. A cooperative energy detecting device 44 is mounted beneath the guide platform in alignment with the source 43, said drug detection means being adapted to indicate the "presence" or "no presence" of an article 18 on the strip 16, as will more fully be explained hereinafter. The energy source for the detection means may be light, sound waves, a stream of air, or other energy source. The detection means 43 and 44 could also be mechanical and be accomplished by a microswitch disposed in the path of the articles 18 on the strip, which switch would close when contacted by the articles themselves. In the latter instance the source of energy 43 would be unnecessary and the device 44 would be replaced by the microswitch whose actuator would come into contact with the articles.

With reference to FIG. 5 of the drawings there is shown a strip 16 including a series of hinge connected coded cards 17 with machine readable language preferrably utilized with the apparatus described hereinbefore. The strip is preferrably made of a relatively heavy, stiff paper, adjacent cards 17 in the strip 16 being connected at their common ends by a hinge that takes the form of a lateral line of perforations 45, the series of cards normally assuming a zig-zag formation within the cabinet base 15. Each card has a longitudinal row of strip feed holes 46 which cooperate with the feed wheel 36 to advance the strip of cards 17 in either direction on the guide platform 31 and through the dispensing station. Each card has a number of longitudinally spaced apart articles 18 detachably positioned on one major face thereof with a portion 47 of each article overhanging a common edge 48 of the cards. The articles are secured to the cards by a suitable adhesive applied between the articles and the major card faces, but other suitable detachable connectors may be employed without a departure from the invention disclosed herein. It is contemplated that the articles 18 could take the forms of controlled drugs in containers such as boxes, bottles, ampules, blister packages, or syringes. The start of a card or series of cards carrying a particular drug, dosage and container form is provided with a combination of machine readable language, such as code holes 50 punched therein and adapted to identify the kind of drug on each particular card or cards and to be read out by the reader head 38 in the search step and counting step of our system. A card or the last card of a series is also provided at a common end adjacent a hinge 45 with code holes 51 adapted to be read by the head 38 to reset the apparatus after the card passes the head, as will be more fully described hereafter. Also between the combination code holes 50 and the reset code holes 51 are codes (not shown) in machine readable language which describe the drug in type, dosage and quantity, i.e., "Morphine Sulfate ¼Gr., 20 ampules."

Figure 7:
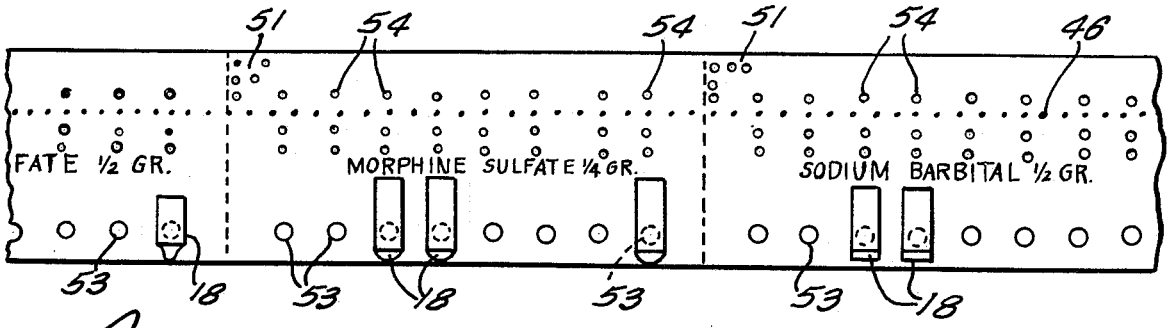
FIG. 7 is a fragmental plan view of our coded cards with machine readable language made up in strip form for use with the modified apparatus shown in FIG. 6.

Now with reference to FIGS. 6 and 7 of the drawings there is shown a modification of our invention wherein the strip guide platform 31 has an opening 52 formed therethrough at the dispensing station and disposed between and in registry with the axially aligned energy source 43 and the detecting device 44. In this form each card 17 of the strip 16 is provided with a longitudinal row of spaced article placement indicator means such as holes 53 over each of which is initially detachably positioned an article 18 in the form of a drug container. Each drug container is detachably secured to the card by a suitable adhesive, or the like, applied between the container and one major face of the card. Position code holes 54 are formed in each card laterally from or adjacent each hole 53 for automatic search and positioning of each drug in an ejecting position at the dispensing station.

It is contemplated that a strip 16 containing a longitudinally spaced apart series of placement indicator holes 53 could be utilized in our system and that other drug identification and readout means could be also employed such as a magnetic tape 55, ink markings 56, or raised projections 57, or other machine readable language (FIG. 9).

FIG. 8 of the drawings shows another modified form of our invention wherein a code punched card 58 (FIG. 9) is provided along one edge with a lateral flange 59, said card being advanced through the cabinet top 19 upon a pair of rollers 60—60 mounted on a bracket 61 depending from the cabinet top wall. A pair of guide rollers 62—62 keep the card in vertical position, the solenoid operated ejector means 39 being adapted to detach a selected drug container 18 from the card and allow it to drop through the drug exit opening 22, the registered guard wheel 24 and into the hopper 30 for dispensation. The reader head 38 and the drug detection means 43 and 44 operate in the same manner as the identical devices provided for the apparatus set forth in FIGS. 6 and 7 of the drawings.

In operation the drug and its identification code 50 for each card or series of cards is determined upon and the strip 16 of cards 17 then provided with the proper drugs, the container for each drug being detachably mounted on common major faces of the cards with a portion 47 of the drug articles 18 overhanging a common edge 48 of the cards (FIGS. 4 and 5). The strip 16 of cards 17 with drugs 18 attached is entered into the cabinet when the cabinet top 19 is in opened position relative to the base 15 by placing a portion of the strip on the platform 31 and allowing the remainder of the strip to be housed in the cabinet base 15, whereafter the cabinet top is closed and locked to the base.

Figure 12:
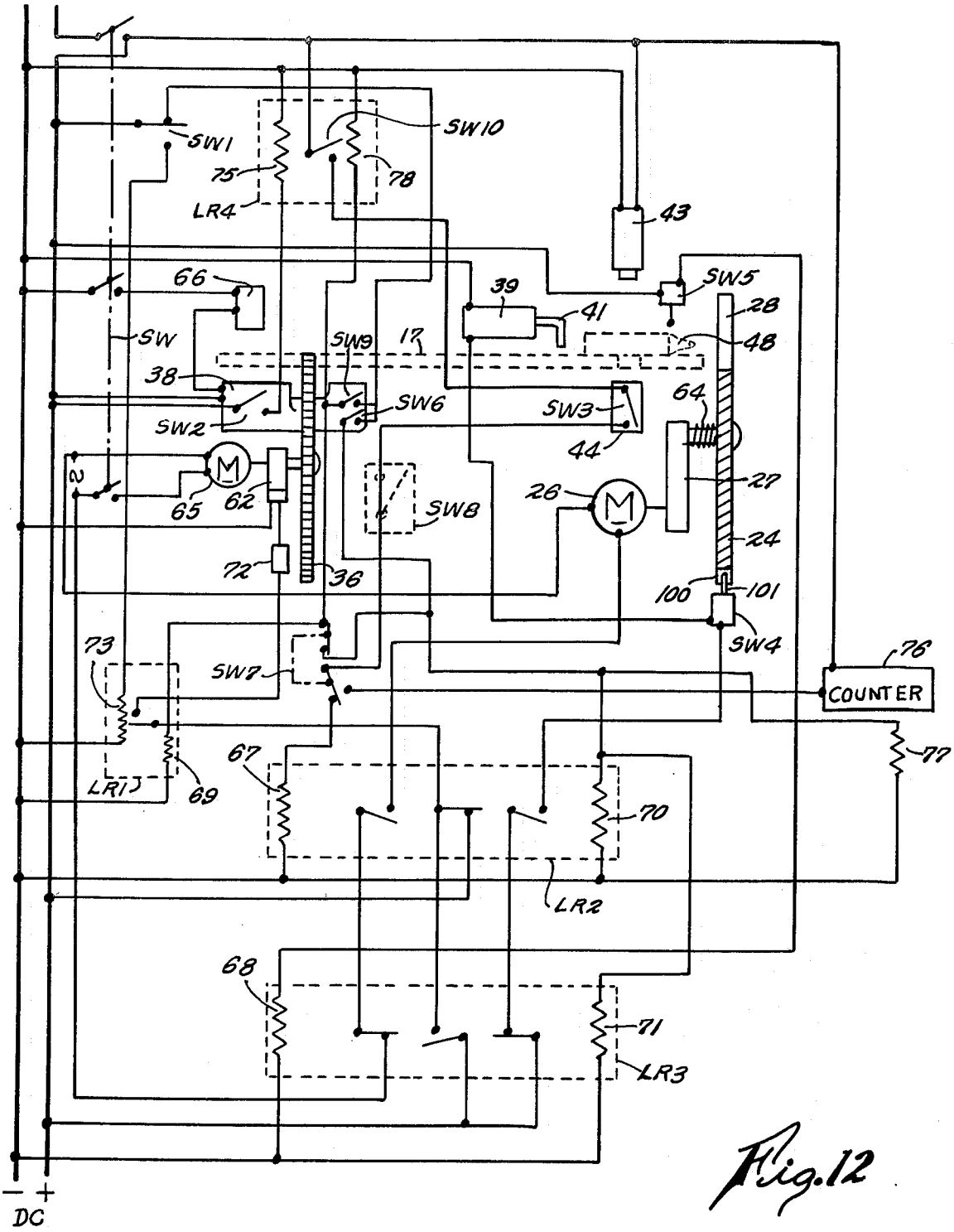
FIG. 12 is a simplified diagramatic view illustrating the cooperative controls for our system carried out with the apparatus shown in FIGS. 1–9 of the drawings.

Now with reference to FIGS. 10 and 12 of the drawings when a required drug or other dispensable article 18 is to be dispensed the code reader head 38 is first programmed, in a conventional manner (not shown), to sense the particular identification code 50 on a card 17 containing the required drug article. Initially locking relays LR1-LR4 will be in the normal positions shown in FIG. 12 of the drawings, the gate 24 will be biased by spring 64 in closed position and a motor 65 for the strip feed wheel 36, energy source 43 and the reader head 38 and a print out device 66, will have been made operative through the making of a gang switch SW. Upon momentary closing of a switch SW1 a set coil 73 of locking relay LR1 will close its switch and complete a circuit through locking relay LR2 to energize a solenoid actuated clutch 62 that will place the motor 65 and the wheel 36 in driving relationship to advance the strip 16 of cards 17 through the dispensing station of the apparatus. When the reader head 38 senses the required identification code 50 on a card 17 identification code activated switch SW2 will close momentarily and energize set coil 75 of locking relay LR4 throwing switch SW10 into a closed position. When the detector 44 indicates that the required drug article 18 is in dispensing position a circuit will be completed through switch SW10, detector actuated switch SW3 of detecting device 44 and set coil 67 of locking relay LR2 to energize relay LR2 and throw its switches into positions opposed to those illustrated in FIG. 12 of the drawings. This position of the switches will disengage the clutch 62 of the strip feed wheel 36 to stop the movement of the strip 16 of cards, energizing microswitch SW4 and causing operation of motor 26 which rotates the guard wheel 24 against bias of its return spring 64 to register the slot 28 with the exit opening 22 in the cabinet. When the slot 28 moves into registration with the exit opening 22 microswitch SW4 completes the circuit which energizes solenoid 39 to eject the drug article 18 through the exit opening 22, the gate slot 28 and into the hopper 30 for dispensation of the drug article. At the completion of the dispensing action solenoid plunder 41 closes a microswitch SW5 which activates the set coil 68 of the locking relay LR3 throwing its switches into positions opposed to those shown in FIG. 12 of the drawings whereby the shutter motor 26 is deenergized and the gate 24 will close by means of its return spring 64. Also microswitch SW4 will be deenergized to permit return of the plunger 41 of solenoid 39 to its retracted position by means of its return spring 42 and return of the gate wheel to closed position will open switch SW4 by reason of the camming action of the notch 100 on the plunger 101. Also upon actuation of locking relay LR3 the clutch 62 will engage the motor 65 and the feed wheel 36 advancing the card and allowing the reader head 38 to continue to control the print out device 66 which types out the name of the drug dispensed, the time, date and other data respecting said dispensed drug until the reset code 51 is sensed by the reader head 38 which closes a reset switch SW6 to activate reset coils 69, 70, 71 and 78 of the locking relays to return all relays and switches to their normal positions.

The reference numeral 72 represents a switch controlled by the accompanying print out device 66 and wired in series with the solenoid actuated clutch 62 whereby advancement of the feed wheel 36 is kept in synchronism with the reader head 38 and with the print out device 66.

The controls illustrated in FIG. 12 of the drawings may be utilized with the apparatus and strip shown in FIGS. 6 and 7 of the drawings by interposing in series a switch SW8 (FIG. 12) in the line between the switch SW7 and the detecting device 44. Switch SW8 closes when the position code 54 is sensed in the reader head 38. Thus if the switch SW3 is also closed due to the presence of a drug at the dispensing station, the drug article dispensing sequence will occur as with the apparatus and cards illustrated in FIGS. 1–5 of the drawings with the advantage that the reader clutch will open and stop the reader in a fixed position in relation to the drug article 18 such as the middle of the drug article.

The counting step (FIG. 11) of our system is initiated by throwing ganged switch SW7 into a position opposite to that shown in FIG. 12. The code reader head 38 is first programmed to sense an identification code signifying the start of the strip loop 17. SW1 is momentarily depressed. This allows energization of set relay 73 of LR1. The switch of LR1 is thrown into a position opposite that shown. The feed wheel 36 is thereby allowed to advance the strip as the clutch 62 is energized and the motor 65 is connected to the feed wheel 36.

When the identification code 50 signifying the start of the strip is sensed, the identification code activated switch SW2 will close momentarily. This closing energizes set coil 75 of locking relay LR4 throwing switch SW10 into a closed position which energizes SW3 of detector 44. When a drug article 18 is detected by detector 44, the switch SW3 closes and the counter 76 is energized momentarily to count this drug article. The absence of a drug will obviously go uncounted. As the counting step continues, the name of the drug, its dosage and the amount of the drug initially present will be read out in the accompanying print out device 66.

When the reset switch SW6 is activated by the reset code, the counter is reset by its reset coil 77. At the same time the number counted is read out on the accompanying print out device. This counting process continues until the end of the strip loop is reached and the counting reset code (not shown) at the end of the strip is sensed which causes closing of SW9 which causes activation of reset coils 78 and 69 of locking relays LR4 and LR1, respectively. This not only deenergized switch SW3 but also clutch 62 and the counting stops.

It will therefore be understood that when a particular drug is to be dispensed the apparatus advances the strip of cards through operation of the feed wheel 36 to a drug dispensing position at the station sensed by the reader head 38 and the detector device 44. If the required drug is positioned on the card portion that is stopped at the station its presence will be detected by the drug detecting device 44 which in turn signals the gate motor 26 to move the gate 24 to open position and also actuates the solenoid 39 to detach the selected drug from the card portion and push it through the exit opening 22 and into the hopper 30 for dispensation. If no drug item covers the particular card portion at the station the search will continue until the item that is called for is found. After dispensation of the required drug article the gate is automatically closed and the apparatus will be shut down until the next succeeding drug dispensing operation is activated.

Other means of counting dispensed drugs periodically should occur to those skilled in the art such as a counter energized by operation of the ejector means and a microswitch that is associated with the counter and mechanically operated by the vacant coded indicator hole 53 on the strip of cards.

What is claimed is:

1. A dispensing and counting system of controlled drugs comprising a strip of cards each with at least one drug placement indicator means thereon, a reset code on each card associated with the indicator means, means detachably connecting a drug on the card adjacent each indicator means, coding means on the strip identifying each drug, search means directing a selected drug to an ejecting means, drug detecting means operative to actuate the ejecting means and detach said drug from a card into a dispensing position, and counting means associated with the detecting means and the indicator means and adapted to determine the number of drugs dispensed from the strip of cards.

2. A security system for dispensing controlled drugs comprising a strip having a plurality of longitudinally spaced apart drug containers on a major face thereof, detachable means securing each container to the strip, placement indicator means on the strip for each container, a dispensing station, power means for moving the strip past the dispensing station, a container ejector disposed adjacent the strip at the station, search means adapted to sense a selected drug container, detecting means cooperative with the search means to render the power means inoperative and stop a selected drug container at the station, means responsive to the presence of a container at the station to actuate the ejector, and counting means associated with the placement indicator means and periodically operative to sense the number of containers dispensed during a preceding period.

3. The security system set forth in claim 2 wherein the placement indicator means is a hole, the drug container is disposed across the hole, and the counting means cooperates with the said hole.

4. The security system set forth in claim 3 wherein the counting means is adapted to sense the absence of a container through the hole.

5. A programmed belt to be used in a machine for the controlled dispensation of drugs comprising a longitudinal row of machine feed holes formed in the belt, a number of cards permanently hinged together end-to-end to form the belt, each card having at least one drug detachably secured thereupon and coded in machine readable language identifying that drug, coded machine placement means on a card for each drug adapted to automatically position a searched for drug for machine detachment from its card, a coded machine reset means on each card, and the coded drug machine identification means on each card related to the coded machine reset means for machine counting of dispensed drugs.

6. A programmed belt to be used in a machine for the controlled dispensation of drugs set forth in claim 5 wherein each card has a plurality of drugs having identical characteristics, and each card having a single coded drug identification means thereon.

7. An article dispensing and counting system comprising a coded strip having a spaced series of article placement indicator means thereon, detachable means initially securing an article on the strip adjacent each placement indicator means, a reset code on the strip for each placement indicator means, an article dispensing station located on one side of the strip, an article ejector, power means moving the strip through the dispensing station at the station, search means cooperative with the reset code to locate a selected article on the strip at the dispensing station, detection means associated with article at the dispensing station for actuating the article ejector, and article counting means operative during actuation of the power means and responsive to the placement indicator means and the detecting means.

8. An article dispensing and counting system comprising a strip having a longitudinally spaced apart series of articles disposed along one edge portion thereof, detachable means securing each article to the strip, machine readable language along the opposite edge portion of the strip identifying the articles, an article ejecting means positioned beside the strip, means advancing the strip past the ejecting means, search means adapted to read the article identification language on the strip, article detecting means cooperative with the search means to stop the strip with a selected article in ejecting position, means actuated by the presence of the selected article in ejecting position to operate the ejecting means and detach the selected article from the strip for dispensation, and periodically operated readout means adapted to count and identify the particular articles detached from the strip.

9. An article dispensing and counting system set forth in claim 8 wherein the articles have end portions overhanging said one edge portion of the strip, and the article detecting means is positioned to sense said article end portions.

10. An article dispensing and counting system set forth in claim 8 wherein the strip has a longitudinally spaced apart series of article placement codes, and the article detecting means is positioned to sense said placement codes.

11. An article dispensing and counting system set forth in claim 10 wherein the strip has a longitudinal series of strip reset codes associated with the article placement codes.

* * * * *